US005956557A

United States Patent [19]

Kato et al.

[11] Patent Number: 5,956,557

[45] Date of Patent: Sep. 21, 1999

[54] IMAGE FORMING APPARATUS AND METHOD FOR CONTROLLING NUMBER OF IMAGE FORMING OPERATIONS

[75] Inventors: Tomokazu Kato, Toyokawa; Hiroyuki Asai, Okazaki; Hidenobu Nakamura, Toyokawa; Tomoyuki Atsumi, Toyohashi, all of Japan

[73] Assignee: Minolta Co., Ltd., Osaka, Japan

[21] Appl. No.: 08/965,475

[22] Filed: Nov. 6, 1997

[30] Foreign Application Priority Data

Nov. 7, 1996 [JP] Japan ..... 8-295140

[51] Int. Cl.[6] ..... G03G 15/00

[52] U.S. Cl. ..... 399/401; 377/8; 399/43; 399/80; 399/364

[58] Field of Search ..... 399/401, 43, 79, 399/80, 361, 363, 364–366, 8, 1; 364/479.01, 479.02, 479.04–479.06; 235/449, 493; 377/8

[56] References Cited

U.S. PATENT DOCUMENTS

| | | | |
|---|---|---|---|
| 4,501,485 | 2/1985 | Tsudaka | 399/79 |
| 5,066,977 | 11/1991 | Yoshizuka | 399/80 |
| 5,117,258 | 5/1992 | Iwata | 399/79 |
| 5,124,754 | 6/1992 | Higaki | 399/366 X |
| 5,300,761 | 4/1994 | Kasahara et al. | 399/79 |
| 5,499,091 | 3/1996 | Kasiwabara et al. | 399/364 |
| 5,694,222 | 12/1997 | Yamada | 399/80 X |
| 5,752,128 | 5/1998 | Yamashita | 399/80 |
| 5,802,423 | 9/1998 | Okunishi | 399/80 |

FOREIGN PATENT DOCUMENTS 61-83552 4/1986 Japan .

*Primary Examiner*—Arthur T. Grimley
*Assistant Examiner*—Quana Grainger
*Attorney, Agent, or Firm*—Morrison & Foerster

[57] ABSTRACT

The invention provides an image forming apparatus such as a coin-operated copy machine, which has an upper limit value to the number of copies which are authorized to be made and which also copies both sides of originals fed to the image forming apparatus. The image forming apparatus is configured so that its intermediate tray, which temporarily stores sheets copied on their first side, is empty at the end of a copy cycle and despite the image forming apparatus being fed more double-sided originals to copy than are authorized to be copied. The image forming apparatus compares the upper limit value of the number of copies authorized to be made to the number of single-sided copies already made in the current copying cycle and begins copying the second side of the originals onto sheets from the intermediate tray when the upper limit value equals a constant K plus twice the number of images formed. The image forming apparatus thus eliminates the problem of single-sided but unfinished copies being present in the intermediate tray when the apparatus is to start its next copy cycle, since the intermediate tray of the image forming apparatus is emptied by the end of the imaging cycle.

20 Claims, 7 Drawing Sheets

IMAGE FORMING APPARATUS AND METHOD FOR CONTROLLING NUMBER OF IMAGE FORMING OPERATIONS

BACKGROUND OF THE INVENTION

1. Field of the Invention

The invention relates to an image forming apparatus capable of forming images on both sides of a copy sheet.

2. Background

In conventional image forming apparatuses capable of forming images on both sides of a copy sheet, when making a plurality of duplex copies, a plurality of copy sheets accommodated in a paper cassette are sequentially fed therefrom and images are formed on the first side of said sheets, and the sheet is subsequently inverted front-to-back and temporarily stored in a re-feeding tray (hereinafter referred to as "intermediate tray") within the apparatus. When image formation on the first side of said plurality of sheets is completed, the copy sheets stored in the intermediate tray are re-fed therefrom, and images are formed on the second side of said sheets, whereupon the sheets are ejected to a discharge tray.

On the other hand, copying machines have been proposed which manage the number of copies that can be made by presetting a maximum number of copies permitted for specific users, and prohibiting a copy operation executing when the accumulated number of copies made by said specific user exceeds said maximum copy number. For example, it is possible to prerecord information on an identification (ID) card including an identification number for a department, a maximum number of copies permitted for said department, and the number of accumulated copies executed by said department, such that copying machines installed in this company can read the information contained by the ID card when the copying machine is used, and prevent a copy operation when the number of accumulated copies reaches the maximum number of permitted copies.

When making multiple sheets of duplex copies in the aforesaid copy machine which has a set maximum copy number limitation, however, a copy operation may be stopped when the maximum copy number is attained during the execution of said duplex copies on multiple sheets, such that some copy sheets may only have images formed on a first side and remain in the intermediate tray.

When desiring to continue duplex copying in such cases, it is necessary to switch the ID card for another indicating the maximum number of copies has not been attained, and then restart the copy operation. Normally, when there is no key input for a predetermined time interval, a copying machine automatically resets the copy mode previously set by the operation panel to improve operation characteristics, or automatically turns OFF the power source to conserve power. Accordingly, when a copy operation is stopped because the number of accumulated copies reaches the set maximum copy number, the copy mode may be reset or the power source may be turned OFF when the aforesaid predetermined time interval elapses before the ID cards can be switched because a new ID card is not readily available. Furthermore, the copy mode may be reset or the power source may be turned OFF when an operator temporarily leaves the site of the copy machine and is unaware that a copy operation has stopped. The copy mode also may be reset when an ID card is pulled from the card reader to replace the ID card.

In the above cases, of course, since a duplex copy mode will also be reset, copy sheets accommodated in the intermediate tray which have not undergone image formation on the second side will have to be removed from said intermediate tray by the operator and reset in the feed tray while taking care to maintain the sheet direction and front-to-back orientation in order to complete the unfinished copying on the second side of said sheets.

Since this procedure is unusually difficult and has a severe adverse affect on operating efficiency, it is typical that the copy sheets in the duplex tray are wastefully disposed of and the duplex copy operation is started over again from the beginning.

The above-described disadvantages are particularly inconvenient in the case of so-called coin vending type copying machines used in convenience stores and the like wherein coins are inserted to purchase an exact number of copies, inasmuch as a copy operation may be stopped during processing when the specified number of duplex copies exceeds that purchased by the inserted coins, thereby preventing the user from achieving the duplex copy objective if sufficient coins are not available.

OBJECTS AND SUMMARY

In view of the previously described disadvantages, an object of the invention is to provide an image forming apparatus which does not waste paper by allowing the making of duplex copies within a set range even when an upper limit of allowed image formations has been set.

Another object of the invention is to provide an image forming apparatus which, when imaging copy sheets on both sides of the sheets during a copy cycle, begins to empty its intermediate tray of any sheets which have been imaged on one side but not their opposite side when the total number of images to be formed on both sides of the sheets meets or exceeds an authorized upper limit value for the number of images to be formed. The image forming apparatus consequently has an empty intermediate tray when the total number of images formed meets or exceeds the number of images authorized to be copied, thereby providing an image forming apparatus which is ready to perform another copy cycle without having to manually remove sheets from the intermediate tray.

It is another object of the invention to provide a control system and a method for controlling an image forming apparatus capable of imaging both sides of copy sheets such that the image forming apparatus does not waste paper and/or so that the image forming apparatus empties its intermediate tray as described above. Other objects of the invention are apparent from the discussion herein.

The invention in one embodiment provides an image forming apparatus which is capable of forming images on both sides of one or more sheets. The image forming apparatus has a number setting means, which sets a number of permitted image formations. The image forming apparatus also has means for counting and temporarily storing the sheets that have been imaged on one side and recirculating the sheets to image the second side of the sheets. The image forming apparatus also has a control means which is configured to stop the feeding of sheets to be imaged on their first side and begin recirculating the sheets to image the second side of the sheets when a number equal to twice the number of sheets imaged on their first sides equals or exceeds the number of permitted image formations. When configured as just described, the image forming apparatus stops imaging the first side of sheets to be imaged and begins imaging the second side of sheets which were previously imaged on their first sides so that the image forming apparatus has no sheets temporarily stored when the copying cycle ends. The number of actual images made is thus either equal to or very close to the number of permitted image formations.

The invention in another embodiment provides a control system for controlling an image forming apparatus. The control system has a first memory unit which is capable of storing an upper limit value of the maximum number of copies authorized to be imaged, a second memory unit which is capable of storing the number of copy sheets imaged in the current imaging cycle, and a comparator having an output capable of providing the output signal to, for example, the paper recirculation unit of the image forming apparatus to begin emptying the paper recirculation unit of copy sheets held there. The control system is configured such that the comparator is capable of receiving and comparing the upper limit value from the first memory unit and the number of copies imaged in the current imaging cycle from the second memory unit and sending the output signal through the output and to the paper recirculation unit when the upper limit value is no greater than the sum of an offset value and twice the number of copies imaged in the current imaging cycle.

In a further embodiment, the invention provides a method for controlling an image forming apparatus. The method comprises obtaining an upper limit value of the maximum number of copies authorized to be imaged; imaging the first side of the sheets, placing the sheets in an intermediate tray, and counting the number of the sheets in the intermediate tray; and removing the sheets from the intermediate tray and imaging the second side of the sheets when the upper limit value of the maximum number of copies authorized to be imaged is no more than the sum of a first number K and a second number equal to twice the value of the number of sheets temporarily stored in the intermediate tray.

DESCRIPTION OF THE PREFERRED EMBODIMENTS

The following description is presented to enable any person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, the invention is not intended to be limited to the embodiments shown, but is to be accorded the widest scope consistent with the principles and features disclosed herein.

The embodiments, of the image forming apparatus of the invention are described hereinafter using an analog copying machine by way of example.

(1) Overall Construction of Analog Copier

Figure 1:
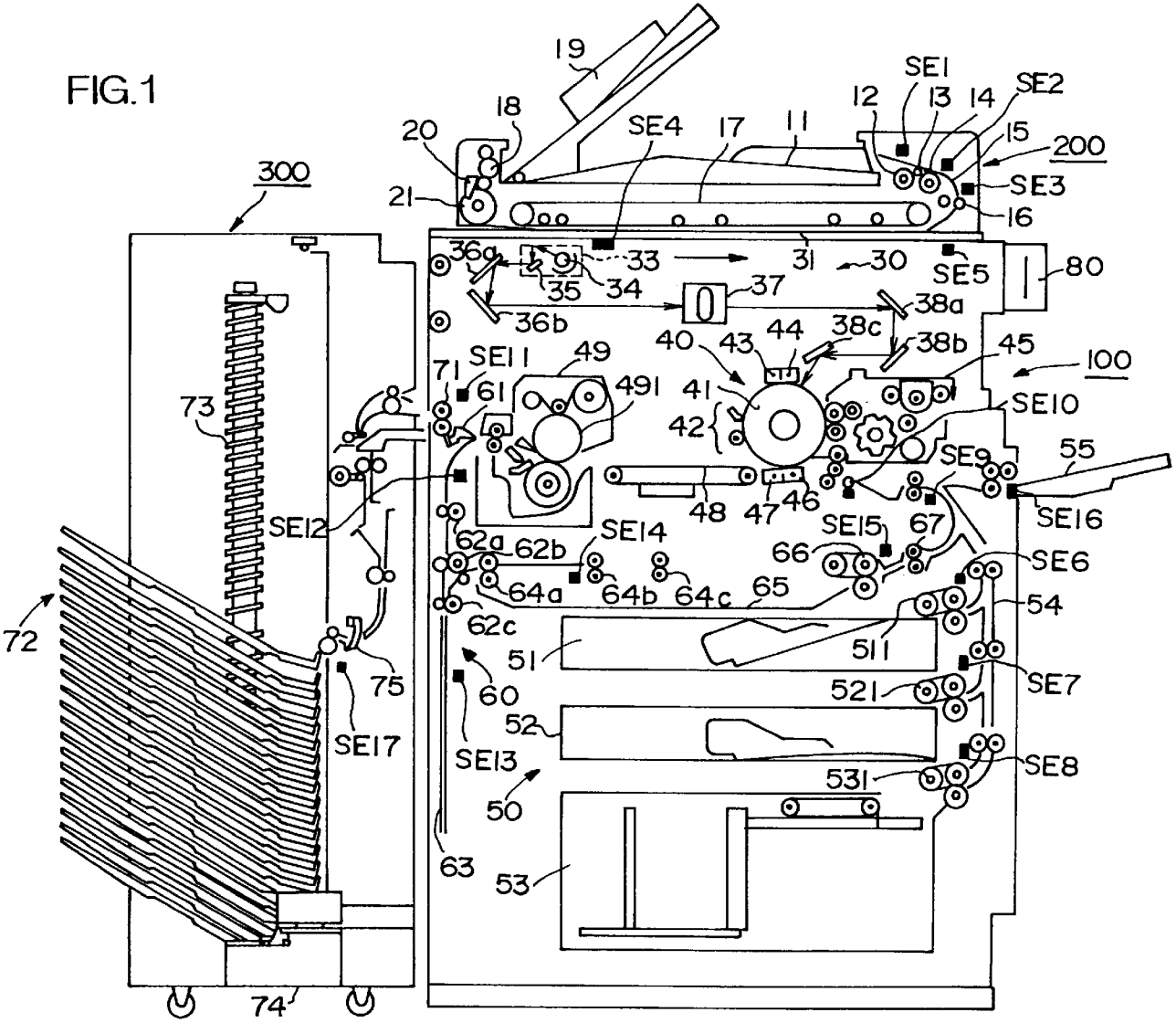
FIG. 1 illustrates the overall construction of an embodiment of the copying apparatus of the invention.

The general construction of an analog copying apparatus (hereinafter referred to simply as "copier") is shown in FIG. 1. Drive means such as motors and the like are omitted from the drawing to facilitate the description.

As shown in the drawing, this copier comprises a document feeder unit 200 and sorter 300 installed in a copier body 100.

Document feeder unit 200 automatically feeds documents to glass document platen 31 of copier body 100. The lowermost document of a stack of documents accommodated in document tray 11 is fed therefrom by take-up roller 12, and individual sheets are separated by rollers 13 and 14 and transported downward along guide 15, and are fed to a predetermined document reading position on glass document platen 31 by registration roller 16 and transport belt 17.

A document transported to the document reading position is scanned by scanner 33 of copier body 100, and subsequently transported in a leftward direction in the drawing by transport belt 17, and passes discharge roller 18 to be ejected to discharge tray 19.

When the back side of this document is scanned, the document transport path is switched to the inversion roller 21 direction by a switch member 20, the document is inverted by said inversion roller 21, and again transported to document platen 31, and is transported to the aforesaid document reading position on document platen 31 by transport belt 17. When the back side of the document is scanned, the document is ejected to document discharge tray 19 by means of the previously described discharge operation, and a next document set on document tray 11 is transported to the document reading position.

Reference number SE1 in the drawing refers to a document sensor used to detect the presence/absence of a document on document tray 11, and SE2 and SE3 refer to sensors that detect the transport state of a document.

Copier body 100 comprises document scanner unit 30, image forming unit 40, paper supply unit 50, and paper recirculating unit 60. Document scanner unit 30 is provided with a scanner 33 underneath document platen 31 and which is moved in the arrow direction in the drawing by a scanner motor (not illustrated). Scanner 33 is provided with an exposure lamp 34, and a mirror 35 which reflects the light reflected from a document illuminated by an exposure lamp 34 in a direction parallel to document platen 31. The light reflected from a document is transmitted by mirrors 36*a* and 36*b*, condensing lens 37, and mirrors 38*a*, 38*b*, 38*c*, and irradiates the surface of photosensitive drum 41 of image forming unit 40.

Image forming unit 40 forms images on a copy sheet by well-known electrophotographic art. Prior to image exposure, residual toner remaining on the surface of photosensitive drum 41 is removed therefrom by cleaning unit 42, and residual charge is discharged from said surface via exposure by eraser lamp 43, after which the surface is uniformly charged by charger 44. When the uniformly charged surface of photosensitive drum 41 is subjected to image exposure, an electrostatic latent image is formed thereon. This electrostatic latent image is developed as a toner image via developing device 45.

Figure 3:
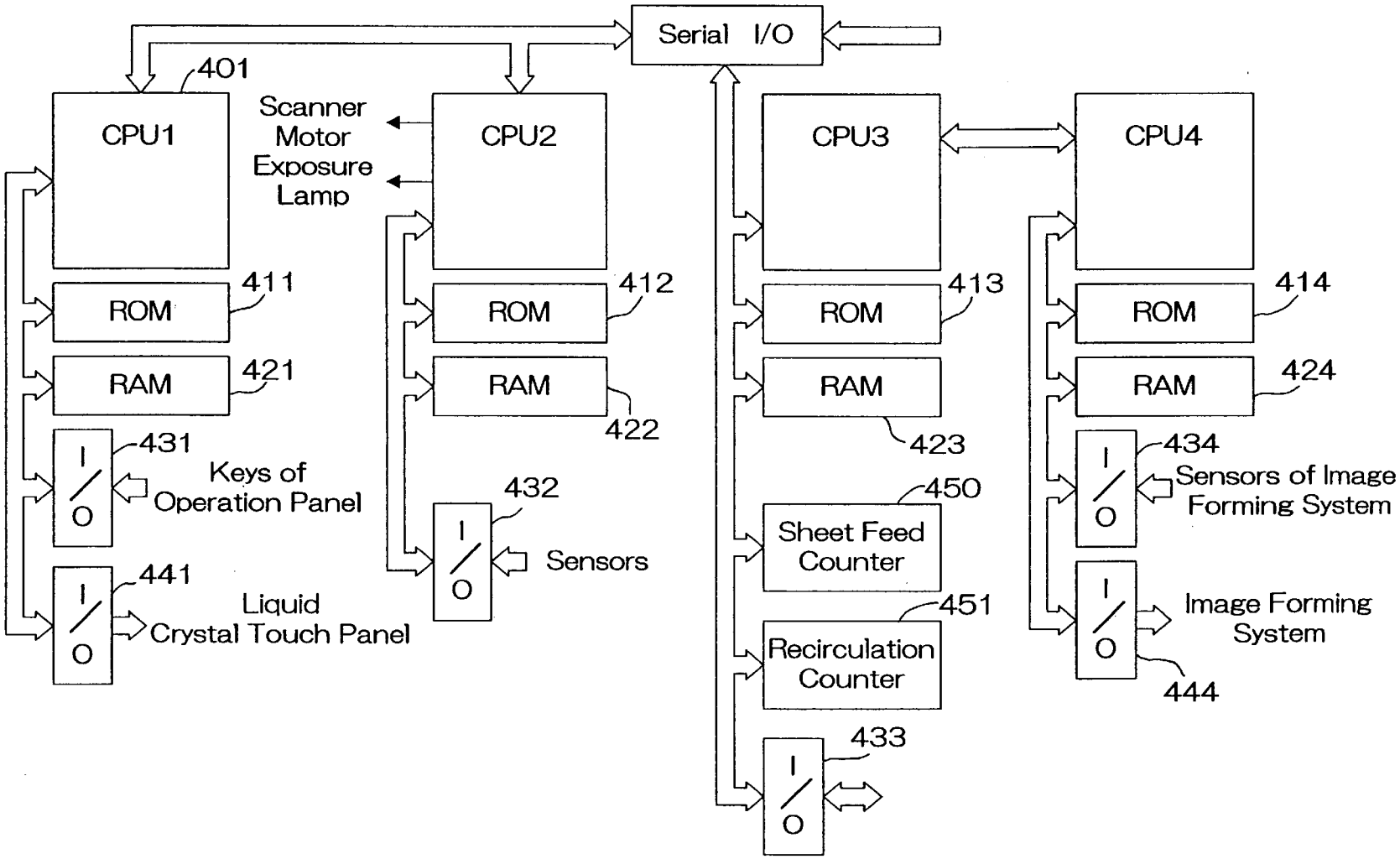
FIG. 3 is a block diagram of the control unit of said copying apparatus.

Paper supply unit 50 is provided with three paper cassettes 51, 52, 53, and the size of the copy sheets accommodated in said paper cassettes is detected by paper size sensors of a photoelectric type (not shown); the detection signal emitted by said sensors is transmitted to a control unit 400 (refer to FIG. 3).

Synchronously with the image forming operation on the surface of photosensitive drum 41, a copy sheet of the required size is fed from one of the paper cassettes 51, 52, or 53 by take-up rollers 511, 521, or 531, passes through paper supply path 54 and transported below photosensitive drum 41 so as to come into contact with the surface of said drum, whereupon a toner image formed on the surface of photosensitive drum 41 is transferred to the surface of the copy sheet by means of an electrostatic force applied by a transfer charger 46.

Thereafter, the copy sheet is separated from the surface of photosensitive drum 41, and transported to fixing device 49 by transport belt 48. In fixing device 49, the toner image on the surface of the transfer sheet is fused to the sheet by a fixing roller 491 provided with an internal heater. After fixing, the copy sheet is transported to sorter 300 by discharge roller 71.

In sorter 300, a plurality of discharge bins 72 are supported by guide rails (not shown) so as to be vertically movable in one direction and an opposite direction; a rod 73 provided with a spiral channel on its exterior surface is driven in rotation by a drive mechanism 74, such that discharge bins 72 are vertically movable by means of the transporting action of said channel. The discharge bin 72 positioned at discharge aperture 75 sequentially changes via the aforesaid vertical movement, such that specific discharge modes may be executed to sort discharge copy sheets. For example, when the normal sorting mode is set as the discharge mode, copy sheets are sequentially ejected sheet-by-sheet from the uppermost bin downward until a set number of copies has been ejected, and when a set number of copies has been completed, copies of a subsequent document are again sequentially discharged from the uppermost bin downward.

When the duplex copy mode is set to copy on the front and back sides of a copy sheet, the leading edge of switch member 61 is moved upward via a solenoid (not illustrated) to change the transport path so as to transport a copy sheet ejected from the fixing device 49 toward recirculation unit 60. When the transport path is changed, a copy sheet enters switching path 63 via transport rollers 62*a*, 62*b*, 62*c*, and then is inverted by transport rollers 62*b* and 62*c*, and temporarily stored in the recirculation intermediate tray 65 via transport rollers 64*a*, 64*b*, 64*c*.

When the first side copies of a set number of copy sheets is completed, the document is ejected to discharge tray 19 by document feeder unit 200, and a next document to be copied on the second side of the copy sheets is fed onto the document platen 31 and scanning starts.

Synchronously with the scanning operation, a copy sheet copied on only the first side is recirculated from intermediate tray 65 to the transfer position below photosensitive drum 41 by feed roller 66 and transport roller 67, and copying on the second side is executed.

Thereafter, the copy sheet passes through fixing device 49, and is ejected to sorter 300 by discharge roller 71, and is deposited in a discharge bin 72 in accordance with a predetermined discharge mode, whereupon the duplex copy operation ends.

Sensor SE4 in copier body 100 is an original document sensor to detect the presence/absence of a document on document platen 31; sensor SE5 is an auto document feeder (ADF) sensor to detect the document feeder unit 200 is connected to copier body 100; sensors SE6 through SE16 are sheet sensors to detect sheet feeding and sheet transport conditions at predetermined locations, and are used to detect paper jams and the like via detection signals of said sensors. In particular, sensors SE6, SE7, SE8, and SE15 detect a copy sheet at the feed apertures of cassettes 51, 52, and 53, and intermediate tray 65, and are used to determine the paper empty condition by control unit 400. Sensor SE14 detects the copy sheet copied on a first side temporarily stored in intermediate tray 65.

Sensor SE 17 in sorter 300 detects whether or not a copy sheet has been ejected to discharge bins 72.

A card reader 80 provided with a built-in magnetic head is provided on the top right side surface of copier body 100 to read information on an ID card including magnetically recorded identification number and the like. This is how the number of copies is managed. This will be described fuller later.

Figure 2:
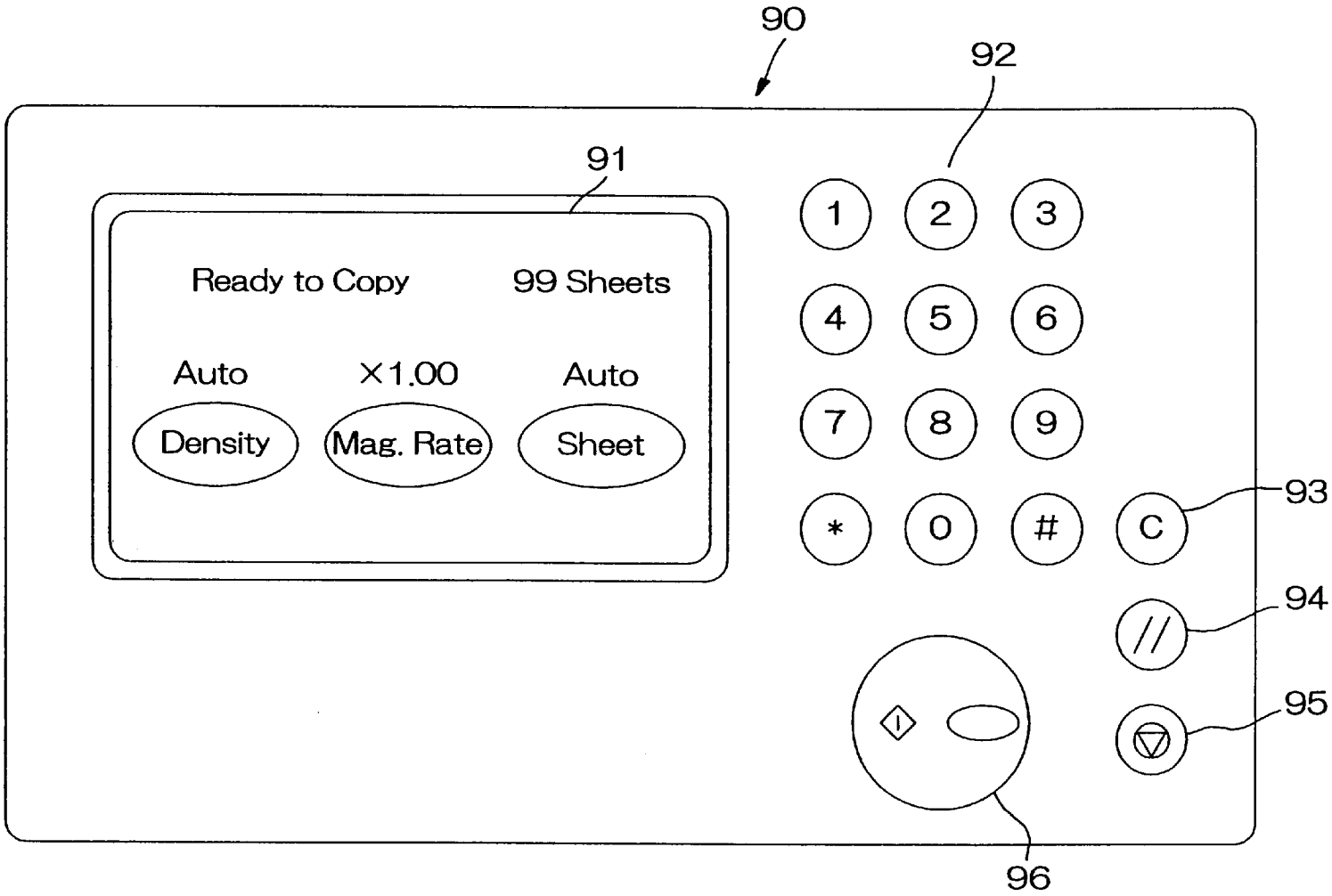
FIG. 2 shows the construction of the operation panel of said copying apparatus.

Operation panel 90 shown in FIG. 2 is disposed at an easily accessible position on the front side of copier body 100. Referring now to the same drawing, operation panel 90 is provided with a liquid crystal touch panel 91 to display various modes, a ten-key pad 92 to input copy number and copy magnification and the like, dear key 93 to return the set copy number to a standard value of [1], panel reset key 94 to return the various conditions within the copier to standard values, stop key 95 to stop a copy operation, and print key 96 to start a printing operation.

Liquid crystal touch panel 91 has a touch panel on the surface of the liquid crystal display, and displays information such as copy number, copy density, copy magnification, and copy sheet size, as well as various abnormal conditions of the copier such as paper jam condition and paper empty condition, and is usable for entering objects by touching the surface of the specific display.

(2) Construction of Control Unit 400

The construction of control unit 400 provided within the aforesaid copier is described below with reference to the block diagrams of FIG. 3 and FIG. 4.

Control unit 400 is built around a total of seven microcomputers 1 through 7 (referred to as CPU 1 through CPU 7 below), and CPU 1 through CPU 7 are provided with read only memories ROM 411 through ROM 417 to store control programs of the respective CPUs, and random access memories RAM 421 through RAM 427 as work areas during program execution.

Serial communications via interrupts are executed among said CPU 1 through CPU 7, so as to exchange commands, reports, and other data.

CPU 1 controls operation panel 90 and transmits the content of instructions specified by operation panel 90 to the other CPUs. That is, signals from the various types of keys of operation panel 90 are received through input/output (I/O) port 431 and the content is stored in RAM 421, and the various control sections are alerted to said contents as necessary, or said signals control the display screen of liquid crystal touch panel 91 via I/O port 411 based on the control program stored in ROM 411.

CPU 2 controls reading/scanning in document scanning unit 30. That is, the presence/absence of a document on document platen 31 is detected via detection signals emitted by document sensor SE4 input through I/O port 432; if a document is present, CPU 2 controls the drive speed of the scanner motor and ON/OFF switching of exposure lamp 34 to accomplish scanning of the document.

CPU 3 executes processes to set the operation mode and adjust the general timing of control unit 400, reads the required control programs from ROM 413, and manages the time via an internal timer, and executes unifying control of the overall processing routines to smoothly accomplish a copy operation.

Furthermore, information contained on the ID card is read by card reader 80 via I/O port 433, including the ID number of the department, the maximum number of authorized copies the department is permitted, and number of accumulated copies to date.

RAM 423 records the identification numbers of the departments permitted to use the copier beforehand, and CPU 3 allows copying and receives input from operation panel 90 only when the identification number read by card reader 80 matches an identification number previously recorded.

CPU 3 determines the difference between the maximum copy number on the aforesaid ID card and the number of accumulated copies to date, and stores said information in RAM 423 as the upper limit value (hereinafter referred to simply as "upper limit value") of the number of copies permitted hereafter.

CPU 3 receives detection signals of the paper sensors SE6, SE7, and SE8 from CPU 4, and counts the number of copy sheets used by incrementing the count value of sheet feed counter 450 by [1] for each copy sheet fed from cassettes 51 through 53, and, when the duplex copy mode is set, increments the count value of recirculation counter 451 by [1] synchronously with the incrementation of feed counter 450 in order to "read ahead" the number of recirculated sheets.

Sheet feeding control during the duplex copy process is accomplished based on the aforesaid upper limit value and the count values of feed counter 450 and recirculation counter 451, and is described fully later.

CPU 4 controls the various operations of image forming unit 40 and paper supply unit 50, and executes consecutive image forming operations (copy process).

That is, ROM 414 stores programs that control the copy process, and CPU 4 controls the operation of the drive units of various parts of the image forming unit via I/O port 444 based on said stored programs so as to execute copies on copy sheets.

At this time, the outputs of charger 49 and transfer charger 46 and the like of image forming unit 40 are adjusted via detection signals from various sensors (not shown) in the image forming system input via I/O 434 so as to obtain optimum control of the image forming process. The sheet feeding operation is controlled by selecting a suitable cassette via size detection signals emitted from the paper size sensor of paper supply unit 50, or a paper jam condition is detected via signals from feed sensors SE6 through SE16, and the condition displayed on liquid crystal touch panel 91 of operation panel 90 via CPU 1.

Figure 4:
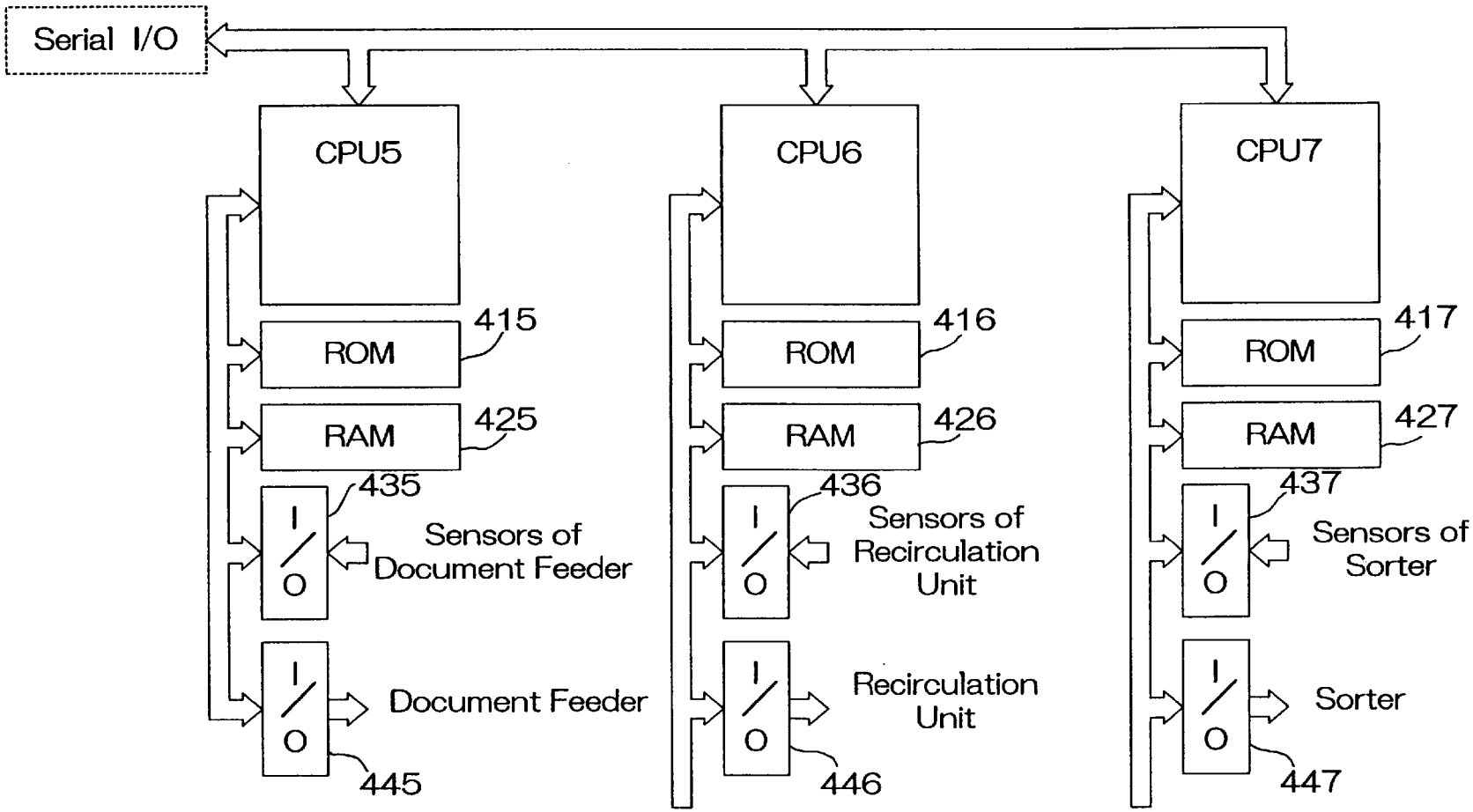
FIG. 4 is a continuation of the block diagram of FIG. 3.

Referring to FIG. 4, CPU 5 controls the document feeder unit 200. CPU 5 adjusts the timing in accordance with the control programs stored in ROM 415 and generates control signals which are transmitted to the drive circuits of various sections via I/O port 445, so as to control document feeding of a document in document discharge tray 19 to the document reading position of document platen 31.

Furthermore, sensor input is received from sensors SE1, SE2, SE3 via I/O port 435 to detect the presence/absence of a document or a paper jam in document feeder 200.

CPU 6 executes controls of the recirculation operation in recirculation unit 60. CPU 6 switches the transport path depending on whether the duplex copy mode or simplex copy mode has been selected, and either ejects simplex copies to sorter 300, or inverts the sheets copied only on a first side and temporarily stores said sheet in intermediate tray 65, and recirculates said sheet to execute copying on a second side.

The drive control of the various sections of recirculation unit 60 detects paper jams via the detection signals of sensor SE 13 input through I/O port 446 or I/O port 436.

CPU 7 controls the sorter 300 based on the control programs stored in ROM 417.

That is, sensor input is received via I/O port 437 from photoelectric sensor SE 17 which detects a discharged copy sheet, and the discharge bin drive circuit is controlled via I/O port 447 while adjusting the timing so as to execute the sorting mode set from operation panel 90.

(3) Control Unit 400 Control Operation

Figure 5:
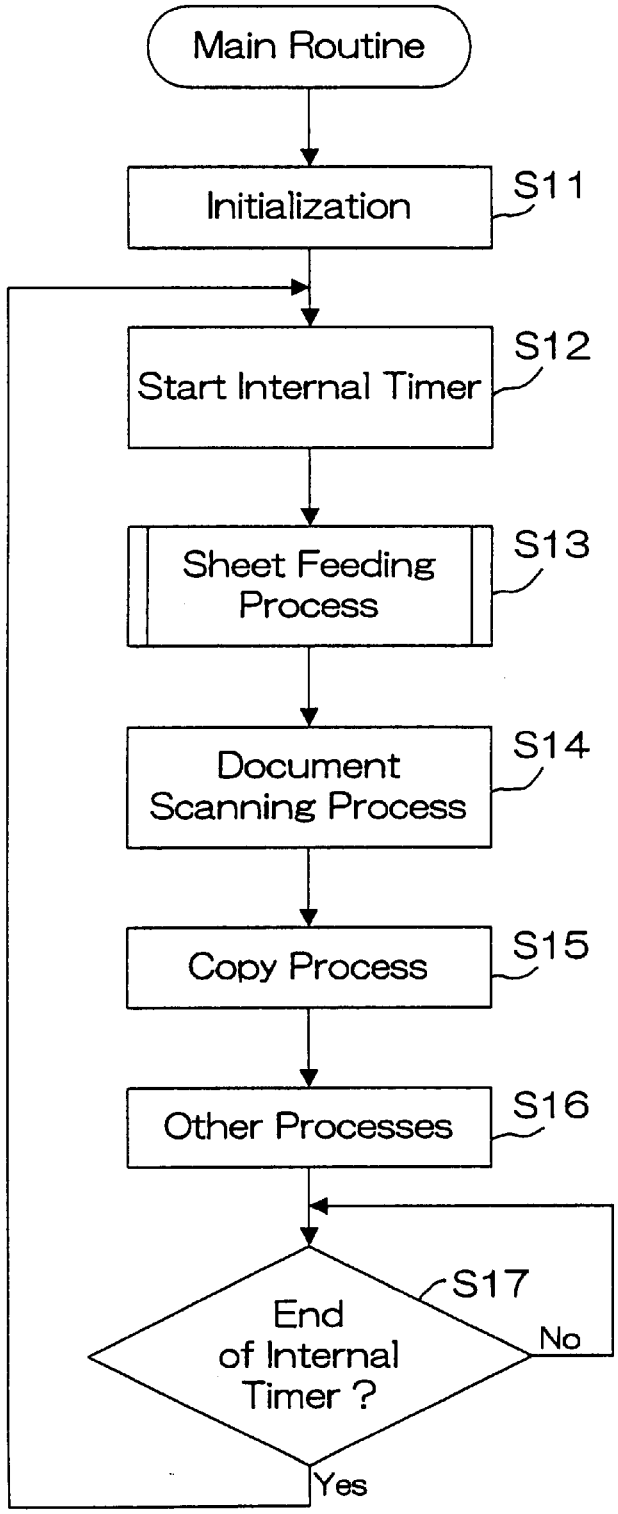
FIG. 5 is a flow chart of the main routine of the control operation executed by said control unit.

FIG. 5 is a flow chart showing the processing sequence of the control operation in control unit 400.

When the main power source of the copier is turned ON, the settings of the various registers within each CPU are initialized and set at initial values (step S11), and the internal timers are started to monitor that the time of the process routines are uniform (steps S12 and S17).

In step S13, the sheet feeding process is executed to supply a copy sheet to the image forming unit 40, and in step S14 the document scanning process is executed, then in step S15 a copy process is executed on a supplied copy sheet. In step S16 other processes are executed, e.g., determination of permitted copy through verification of ID card identification number, and copy mode setting via key input from operation panel 90.

After the aforesaid processing, the completion of the internal timers is awaited (step S17), whereupon the routine returns.

Figure 6:
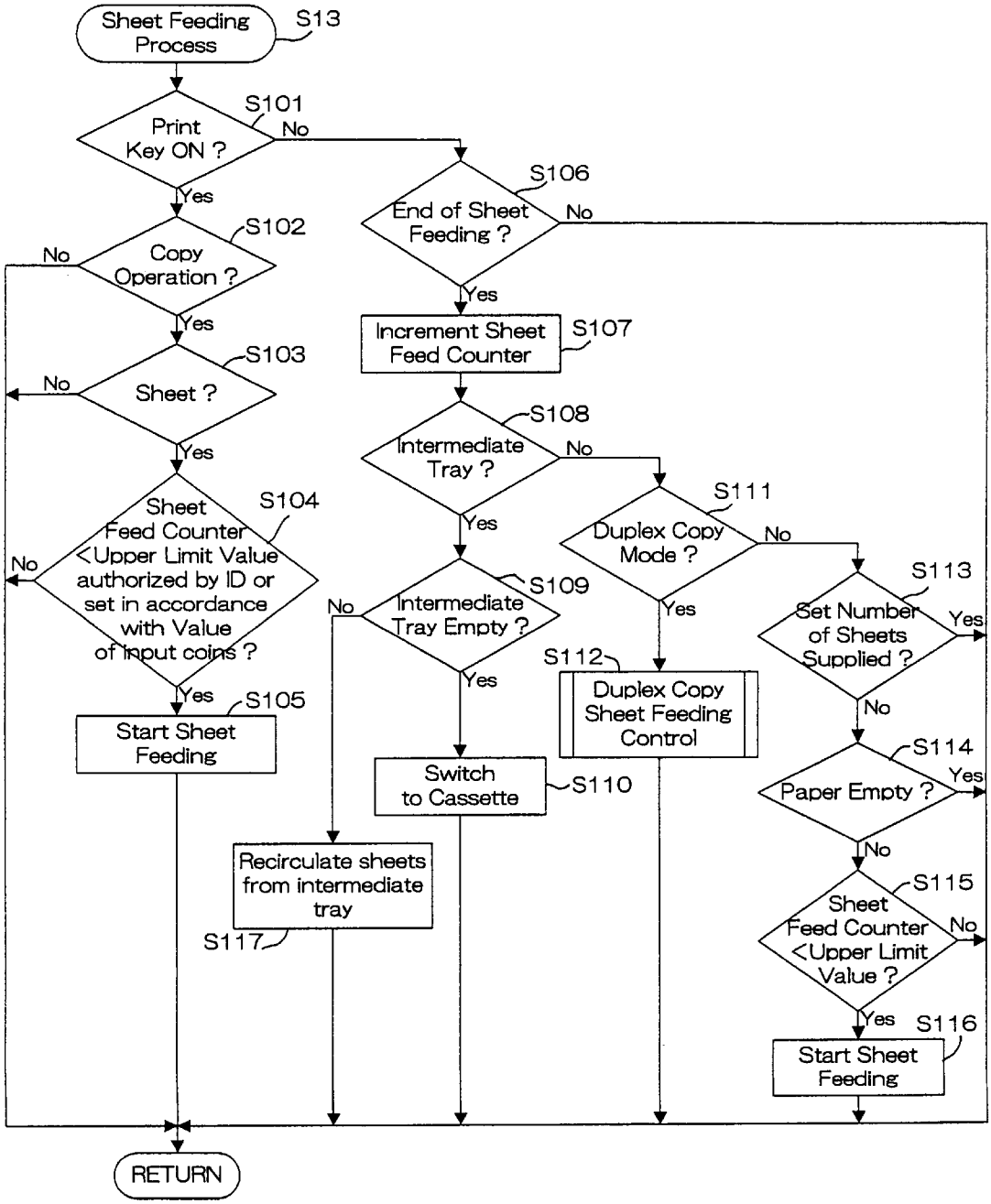
FIG. 6 is a flow chart of the subroutine of the sheet feeding process (step S13) of FIG. 5.

FIG. 6 is a flow chart showing details of the subroutine of the sheet feeding process in step S13. The control of this sheet feeding process is mainly accomplished by CPUs 1 and 4 via instructions from CPU 3. After copy permission is verified by the ID card identification number and the predetermined copy mode is set from the operation panel 90 by a user, the print key 96 is pressed (FIG. 2). CPU 1 monitors the output from print key 96 and detects the change of key output from OFF to ON when key 96 is pressed (step S101: YES), and reports this information to CPU 4 which then determines whether or not a copy operation is currently executing (step S102). If a copy operation is not currently executing, a check is made to determine whether or not a sheet is present at the supply aperture of a paper cassette 51, 52, or 53 (cassette 51 is selected in the following description) selected via the copy mode setting via the detection signal of sensor SE6 (FIG. 1) (step S103).

When it is determined that a sheet is present at the supply aperture of cassette 51, CPU 3 determines whether or not the count value of counter 450 is less than the aforesaid upper limit value (step 104). If the count value is less, copying is enabled and a sheet starts feeding from cassette 51 (step S105).

When the ON state of the print key is not detected in step S101, the routine jumps to step S106 and CPU 4 determines whether or not sheet feeding has ended. Specifically, when the trailing edge of a sheet fed from a cassette is detected by sensor SE6 provided at the supply aperture of cassette 51, the completion of the sheet feeding is determined, and this information is reported to CPU 3.

Thus, CPU 3 increments the count value of sheet counter 450 by [1] (step S107), and thereafter determines whether or not the feed aperture of intermediate tray 65 has been selected (step S108). If the feed aperture of intermediate tray 65 has not been selected, the routine jumps to step S111 and a determination is again made as to whether or not the duplex copy mode has been set. When the duplex copy mode has not been set, the routine jumps to step S113 and a determination is made as to whether or not the set number of sheets has been supplied. Since an operator inputs the required number of copies via the ten-key pad 92 when setting the copy mode, and since this number is stored in RAM 421, this information can be supplied to CPU 3 via serial input/output, such that when the count value of counter 450 attains said set number, the feeding of the set number of sheets is determined to be completed (step S113: YES), and the routine returns.

If the paper accommodated on cassette 51 is depleted (i.e., paper empty condition) before the set number of sheets has been fed (step S113: NO), it is verified that the feed counter has not attained the upper limit value, and the feeding of the next copy sheet is started (steps S114, S115, S116).

When a paper empty condition is determined in step S114, or when the feed counter attains the upper limit value in step S115, the routine returns directly without feeding a new sheet. In the case of the paper empty condition, the operator is alerted by a paper resupply message on the liquid crystal touch panel 91, and in the case of attaining the upper limit value, a message alerting the operator that additional copies cannot be made because the upper limit value of permitted copies has been attained is similarly displayed on liquid crystal display 91.

The aforesaid paper supply process pertains to the simplex copy mode, the paper supply process for the duplex copy mode is described below.

Although the duplex copy mode is described below in terms of copying the images of two documents to the front and back sides of a copy sheet, it is to be noted that the duplex copy mode further pertains to copying the front and back images of a single document to the front and back sides of a copy sheet.

In step S111, a determination is made as to whether or not the duplex copy mode is currently set. If the duplex copy mode is set, the duplex copy sheet feeding control is executed in step S112.

Figure 7:
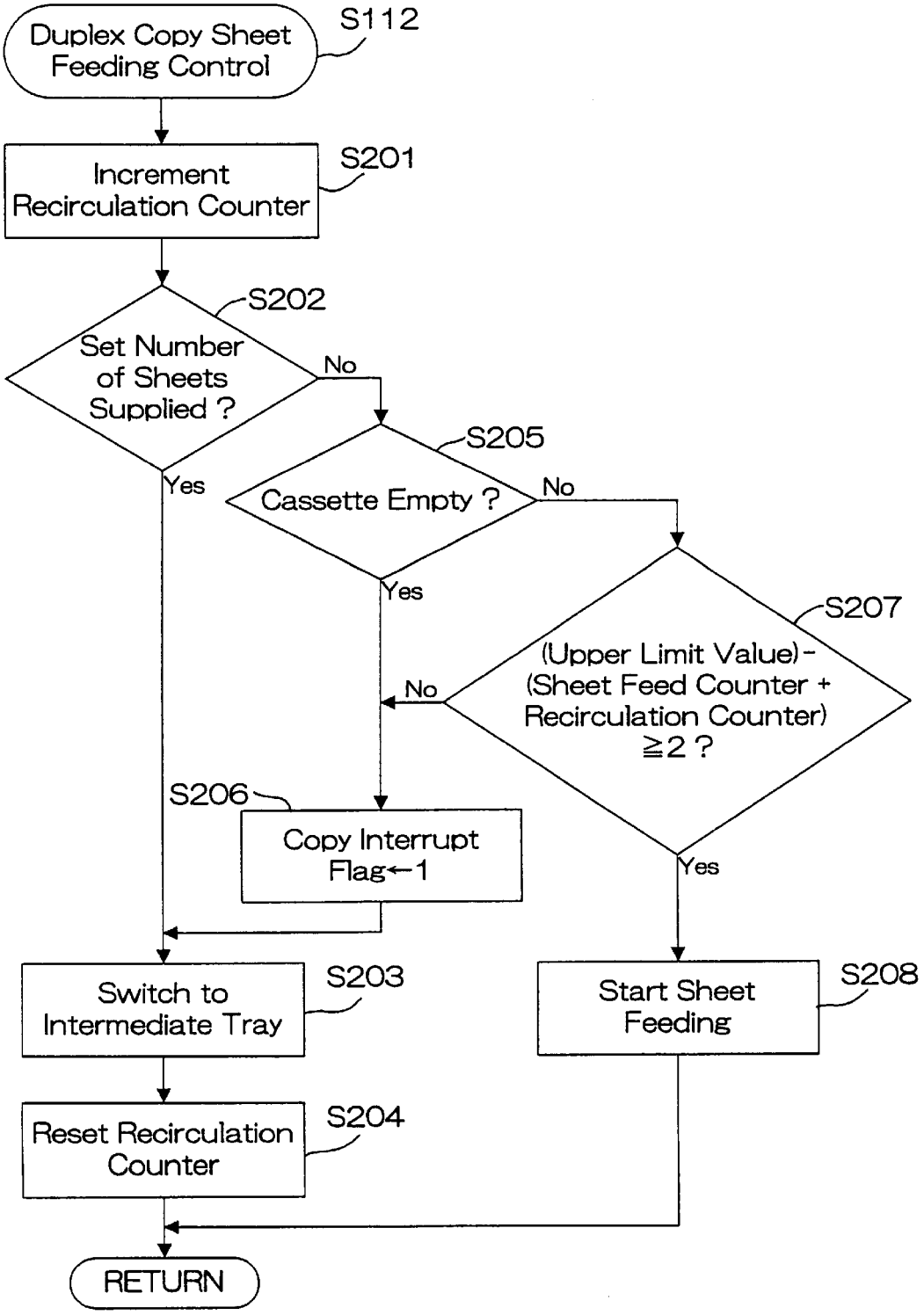
FIG. 7 is a flow chart of the subroutine of the duplex copy sheet feeding control (step S112) of FIG. 6.

FIG. 7 is a flow chart showing details of the subroutine of the duplex copy sheet feeding controls of step S112. First, the count value of recirculation counter 451 is incremented by [1] (step S201). In the immediately preceding step S107 (FIG. 6), the feed counter 450 was also incremented by [1]. When the duplex copy mode is set, the recirculation counter is incremented by [1] for every copy sheet fed from cassette 51, such that the number of supplied sheets is read beforehand when recirculating sheets from the intermediate tray 65.

Then, a check is made to determine whether or not the set number of sheets have been fed from cassette 51 via the count value of counter 450 (step S202). If the sheet feeding is completed, the paper supply aperture is switched to intermediate tray 65, the second side copy is made (step S203), the count value of the recirculation counter 451 is reset (step S204), and the routine returns.

If it is determined that the set number of sheets have not been fed in step S202, a check is first made to determine whether or not cassette 51 has a paper empty condition (step S205), and if the paper has been depleted, the sum of the feed counter value and the recirculation counter value is subtracted from the upper limit value to determine if the remainder is [2] or greater (step S207).

If the remainder is [2] or greater, the routine jumps to step S108 because it is possible to copy both the first side and the second side within the upper limit value even if a new sheet is fed, and the feeding of the next sheet from cassette 51 is started, and the routine returns. Conversely, since it is clear that the second side cannot be copied even if a new sheet is fed when the remainder is less than [2], i.e., when the remainder is [1] or [0], the routine jumps to step S206, and after the copy interrupt flag is set at [1], the feed aperture is switched to intermediate tray 65 and the second side is copied (step S203), and the count value of the recirculation counter 451 is reset (step S204). Since a new sheet cannot be fed when a paper empty condition is determined in step S205, the routine advances through steps S206, S203, and S204 and the second side is copied without making the determination in step S207.

In the sheet feeding control of the duplex copy mode, the sheet feeder aperture is switched to the intermediate tray 65 and the second side of said sheet is copied when (1) the set number of sheets have been fed from cassette 51 and the first side copies have ended (step S202), (2) the paper in cassette 51 is depleted before the set number of sheets have been fed (step S205), and (3) the number of copies exceeds the upper limit value when making second sides copies and sheets are still being fed before the set number of fed sheets has been attained (step S207).

Referring now to FIG. 6, in the duplex copy sheet feeding control of step S112, the feed aperture is switched to intermediate tray 65, the routine returns and the sheet is recirculated, then when step S108 is again reached, the reply to the query is YES, and the routine continues to step S109, and a determination is made as to whether or not intermediate tray 65 has a paper empty condition. If intermediate tray 65 is empty, the second side copies of the copy sheets accommodated in intermediate tray 65 have been completed, and the feed aperture is switched to the main unit side (cassette 51 side), and the first side copies of a next document are made (step S110).

If, on the other hand, intermediate tray 65 is not found to be empty in step S109, recirculation of sheets from intermediate tray 65 is started (step S117).

(4) Modifications

Although the embodiments of the invention have been described in terms of a copying machine in the foregoing description, it is to be understood that the invention is not limited to the aforesaid embodiments.

The aforesaid embodiments have been described in terms of reading information from an ID card via a card reader 80 to manage the number of copies, but the number of permitted copies allotted to each department is pre-stored and the total number of current used copies of each department may be stored in the memory of the control unit within the copier for the purposes of managing the number of allowed copies. Furthermore, the identification number of the user department may be input directly from the ten-key pad of operation panel 90 rather than via the ID card.

The invention is also applicable to the coin vending type copying machine. In this case, the upper limit value of the permitted number of copies is set in accordance with the value of input coins instead of information read from the ID card by card reader 80.

Occasionally, an operator may input the upper limit value of the number of copies herself from the ten-key pad of operation panel 90 for each use, so as to self-manage the number of copies thereby.

In step S207 (FIG. 7) of the subroutine of duplex copy sheet feeding control of the previously described embodiments, the routine may terminate sheet feeding from cassette 51 and move to second side copying when the remainder is less than [2] when subtracting the sum of the feed counter and the recirculation counter from the upper limit value of the permitted number of copies so as to have no sheets remaining in the intermediate tray 65.

That is, when the upper limit value is designated M and the feed counter value is designated N, the recirculation counter value also becomes N in the duplex copy mode, such that when M−2N<2, i.e., when M−N=N or N+1, the routine moves to second side copying. At the stage wherein N sheets have been fed from cassette 51 and the first side copies have been completed, N or N+1 copies remain until the upper limit value is attained, such that all the fed copy sheets can be used for duplex copying and no simplex copies will remain in the intermediate tray 65. Thus, the value M−2N can be zero or positive.

When the upper limit value is an odd number, however, a single permitted copy will remain even after all fed sheets are used for duplex copies. A user may make a final single simplex copy to attain the upper limit value, such that the relationship M−N=N−1 may be used.

In this instance, since it is determined that only a single simplex copy can be made on a copy sheet at the moment the final sheet is fed from cassette 51, after copying to the first side of said copy sheet the sheet may be directly ejected to a predetermined discharge bin 72 of sorter 300 without being transported to recirculation unit 60, thereby conveniently eliminating the trouble of removing the simplex copy sheet from the intermediate tray 65. In other words, applying the relationships set forth above, the control system of this invention compares the upper limit value M from the first memory unit and the number of copy sheets N imaged in the current image forming cycle from the second memory unit and sends an output signal through the output and to the paper recirculation unit when the upper limit value M is no greater than a sum of a value that is −1 or greater and twice the number of copy sheets N imaged in the current image forming cycle.

To further this idea, a predetermined positive integer K may be determined such that if sheet feeding is stopped and the routine moves to second side copying when M−N=K, not less than K sheets will be used to execute duplex copies, thereby reducing wasteful use of copy sheets without the concern of completing only simplex copying of all fed copy sheets as in conventional apparatuses.

Although the image forming apparatus of the invention is applied to a copying machine in the previously described embodiments, it is to be understood that it is also applicable to other image forming apparatuses such as printers and facsimile machines and the like.

According to the invention as described above, in an image forming apparatus which forms an image on a first side of a copy sheet, temporarily stores said copy sheet in an intermediate tray, then recirculates said copy sheet to form an image on a second side thereof, the number of sheets fed from a supply means is counted, and when the value of the difference between the number M of permitted image formations and the count value N of the number of fed sheets (i.e., M−N) is a positive predetermined value K, the feeding of copy sheets by said supply means is stopped and copy sheets stored in an intermediate tray are recirculated so as to form images on the second side of said copy sheets insofar as said image formations are within a range which does not exceeds a permitted number of image formation, thereby accomplishing first side and second side copies on at least K sheets, and avoiding wasting of all fed copy sheets as when the number of permitted image formations is reached during image formations on a first side as in conventional apparatuses.

Furthermore, since the predetermined value K is set at N or N+1, at least all fed copy sheets normally can be used for image formation on a second side insofar as said image formations are within the range of the permitted number of image formations M, thereby avoiding the waste of copy sheets.

What is claimed is:

1. An image forming apparatus capable of forming images on one or more sheets, said image forming apparatus comprising:

a) number setting means for setting a number M of permitted image formations;

b) means for forming an image on a first side of said sheets fed from a sheet supplying means, temporarily storing said sheets, then recirculating said sheets by a recirculating means and forming an image on a second side of said sheets;

c) counting means for counting a number N of said sheets fed from said sheet supplying means; and d) control means configured to stop the feeding of said sheets by said sheet supplying means and to cause said recirculating means to recirculate said sheets to form the image on the second side of said sheets when the set number M is less than or equal to a sum of an offset value that is zero or positive and twice the number N.

2. The image forming apparatus of claim 1 wherein the number setting means comprises a means to read information from a magnetic card.

3. The image forming apparatus of claim 1 wherein the counting means comprises a sensing means for sensing said sheets as they pass the sensing means and at least one number-storing means for storing the number of sheets sensed by the sensing means.

4. The image forming apparatus of claim 1 wherein the counting means comprises two number-storing means, each of which stores the number of sheets sensed by the sensing means.

5. The image forming apparatus of claim 1 wherein the control means comprises a central processing unit.

6. A control system for controlling an image forming apparatus that is capable of forming images on one or more copy sheets having printing on both sides which image forming apparatus has a paper recirculating unit which receives and temporarily stores said copy sheets during an image forming cycle and which, in response to an output signals empties when the image forming cycle ends, wherein said control system comprises a first memory unit which is capable of storing an upper limit value of a maximum number of copies authorized to be imaged, a second memory unit which is capable of storing a number of copy sheets imaged in the current image forming cycle, and a comparator having an output capable of providing the output signal to the paper recirculation unit of said copy sheets, and wherein the system is configured such that the comparator is capable of receiving and comparing the upper limit value from the first memory unit and the number of copy sheets imaged in the current image forming cycle from the second memory unit and sending the output signal through the output and to the paper recirculation unit when the upper limit value is no greater than a sum of a value that is −1 or greater and twice the number of copy sheets imaged in the current image forming cycle.

7. The control system of claim 6 wherein the control system further includes a magnetic card reader which is configured to supply information on the upper limit value to the comparator.

8. The control system of claim 6 further comprising a third memory unit which is capable of storing the number of copy sheets imaged in the current image forming cycle and wherein the comparator is configured to receive the number of copy sheets imaged in the current image forming cycle and compare the upper limit value to the numbers stored in the second and third memory units and send said output signal through the output and to the paper recirculation unit when the upper limit value is no greater than a sum of the positive offset value and the numbers stored in the second and third memory units.

9. The control system of claim 6 wherein the comparator is configured to send the output signal through the output and to the paper recirculation unit when the upper limit value is no greater than the sum of the offset value and twice the number of copy sheets imaged in the current image forming cycle, and wherein the offset value is a number selected from a set consisting of one, zero, and negative one.

10. A method for controlling an image forming apparatus that is capable of forming images of documents on one or more sheets having printing on a first side and a second side of each of the sheets, where the image forming apparatus temporarily stores the sheets in an intermediate tray during imaging of the first side of the sheets and the image forming apparatus removes the sheets from the intermediate tray during imaging of the second side of the sheets, said method comprising the steps of:

a) obtaining an upper limit value of a maximum number of copies authorized to be imaged;

b) imaging the first side of the sheets, temporarily placing the sheets in the intermediate tray, and counting a number of sheets in the intermediate tray; and c) removing the sheets from the intermediate tray and imaging the second side of the sheets when the upper limit value of the maximum number of copies authorized to be imaged is no more than a sum of a first positive offset number K and twice the number of sheets temporarily stored in the intermediate tray.

11. The method of claim 10 further comprising feeding the sheets with printing on the first side to the intermediate tray and counting the number of sheets fed to the intermediate tray and storing this value of the number of sheets temporarily stored in the intermediate tray in a first counter.

12. The method of claim 11 further comprising storing the value of the number of sheets temporarily stored in the intermediate tray in a second counter, and wherein the step of removing sheets from the intermediate tray comprises removing the sheets from the intermediate tray and imaging the second side of the sheets when the upper limit value of the maximum number of copies authorized to be imaged is no more than the sum of the first number K and the second number equal to the sum of the values in the first counter and the second counter.

13. The method of claim 10 wherein the step of imaging the first side comprises forming images on the first side of said sheets, and the step of imaging the second side comprises forming images on the second side of said sheets.

14. The method of claim 10 wherein the step of imaging the first side comprises scanning images from the first side of said documents, and the step of imaging the second side comprises scanning images from the second side of said documents.

15. The method of claim 10 wherein the step of obtaining the upper limit value comprises reading a magnetic card which contains information sufficient to calculate the upper limit value and determining the upper limit value from said information.

16. An image forming apparatus that is capable of forming an image on a first side and a second side of each of one or more sheets, said image forming apparatus comprising:

a) a first memory unit which is capable of storing an upper limit value of a maximum number of copies authorized to be imaged;

b) a second memory unit which is capable of storing a number N of sheets whose first sides have been imaged;

c) a paper recirculation unit which is capable of receiving the sheets from an imager after the first side is imaged, temporarily storing the sheets in an intermediate tray, and feeding the sheets to the imager to image the second side of the sheets; and d) a control unit, e) wherein the control unit, first memory unit, second memory unit, and intermediate tray are configured such that the control unit receives the upper limit value from the first memory unit and the number N of sheets whose first sides have been imaged from the second memory unit, and the control unit is further configured to cause the intermediate tray to switch from receiving the sheets from the imager to feeding the sheets to the imager when the upper limit value is no more than a sum of a first positive offset number K and twice the number N of sheets whose first sides have been imaged.

17. The image forming apparatus of claim 16 further comprising a third memory unit which is capable of storing the number N of sheets whose first sides have been imaged, wherein the control unit is configured to receive the number N of sheets whose first sides have been imaged from the third memory unit, and wherein the control unit is configured so that said second number is the sum of the number N from the second memory unit and the number N from the third memory unit.

18. The image forming apparatus of claim 17 further comprising a magnetic card reader having a magnetic head which is configured to supply information on the upper limit value to the control unit.

19. The control system of claim 6, wherein the control system further includes a coin reader which is configured to supply information on the upper limit value to the comparator.

20. The image forming apparatus of claim 17, further comprising a coin reader which is configured to supply information on the upper limit value to the control unit.

* * * * *